US007093368B1

(12) United States Patent
Nelson

(10) Patent No.: US 7,093,368 B1
(45) Date of Patent: Aug. 22, 2006

(54) ENGRAVING TOOL DEPTH CONTROL NOSEPIECE FOR ENHANCING LINE UNIFORMITY

(76) Inventor: Lance Nelson, 5 Rock Ave., Hudson, MA (US) 01749

( * ) Notice: Subject to any disclaimer, the term of this patent is extended or adjusted under 35 U.S.C. 154(b) by 0 days.

(21) Appl. No.: 11/125,346

(22) Filed: May 9, 2005

(51) Int. Cl.
*B43L 13/00* (2006.01)

(52) U.S. Cl. ..... 33/18.1

(58) Field of Classification Search ..... 33/18.1
See application file for complete search history.

(56) References Cited

U.S. PATENT DOCUMENTS 2,269,616 A * 1/1942 Yuhase ..... 33/834
3,001,272 A * 9/1961 Picola ..... 29/407.09
4,630,378 A * 12/1986 Kulp et al. ..... 33/628
4,815,218 A * 3/1989 Gordy ..... 33/628
6,460,258 B1 * 10/2002 Shimotoyodome ..... 33/18.1
6,834,434 B1 * 12/2004 Nelson ..... 33/18.1

OTHER PUBLICATIONS

Gravograph Catalog two Pages p. 17-18; Chapter 4; Table Adjustments; http://www.gravograph.com; Gravograph Inc, Duluth, GA USA Apr. 19, 2005.
"High Speed Engraving"; KaVo GmbH, Leutkirch, Germany; http://kavo-drives.com; 4 pages.

* cited by examiner

*Primary Examiner*—Christopher W. Fulton
(74) *Attorney, Agent, or Firm*—Robert Nathans

(57) ABSTRACT

Engraving tool bit depth controlling nosepiece adjustment devices establish a precise protrusion distance that an engraving tool bit protrudes from the end of the nosepiece of a spring loaded engraving tool, that is in turn inserted within and driven by a standard machine tool such as a cnc type milling machine. One rotational adjustment device establishes the axial position of the nosepiece with respect to a collet nut of the engraving tool and another adjustment device employs annular ring spacers in the form of washers between the nosepiece and collet nut to precisely establish the desired engraving tool bit protrusion distance from the end of the nosepiece. This modification of a spring loaded engraving tool beneficially prevents the engraving tool bit from being able to plunge too deeply into the workpiece, particularly at the start of each engraved line, to thus ensure that all the lines will be consistent.

21 Claims, 2 Drawing Sheets

ENGRAVING TOOL DEPTH CONTROL NOSEPIECE FOR ENHANCING LINE UNIFORMITY

BACKGROUND OF THE INVENTION

This invention relates to the field of engraving machines.

Engraving with a computer numerically controlled (cnc) type milling machine is typically performed by the following method. A pointed engraving tool is held in a rigid collet or endmill holder and rotated in the spindle of a cnc milling machine. The cnc milling machine controls the depth of engraving by plunging the pointed engraving tool down into the workpiece by a fixed amount. The cnc milling machine then moves the engraving tool across the surface of the part to be engraved at that specific depth. If the material to be engraved is not perfectly flat on the cnc machine table, the engraving will not look even. Some areas of the engraving will be deeper than others and some areas may not be engraved at all.

To overcome this problem, a floating spring loaded engraving tool that is held in a collet and rotated in the spindle of a cnc milling type machine may be used. Such a tool is disclosed and claimed in Nelson U.S. Pat. No. 6,834,434 issued Dec. 28, 2004 and is incorporated by reference herein. A spring provides the pressure to push the engraving tool against the workpiece being engraved. The depth of engraving is controlled by both the strength of the spring and the feedrate of the tool across the surface of the workpiece. If the rate of travel of the engraving tool across the surface being engraved is slow, the engraving tool has more time to press against the workpiece and therefore plunges deeper into the surface. Speeding up the feedrate of the engraving tool over the surface of the workpiece allows less time for the tool to plunge into the surface so shallower engraving is produced. Using this method of adjusting the feedrate to control the depth of engraving is effective; however a technique to provide absolute depth control is often desired for the following reasons.

When the spring loaded engraving tool is used to engrave very soft materials such as plastic, there is a possibility that the engraving tool will penetrate too deeply when the tool begins its first cut. The cnc machine moves the tool to the beginning of the line to be engraved and plunges the tool to the specified depth. The tool is then moved across the surface of the workpiece to be engraved at a specific feed rate. When the tool is moved across the surface of the work piece at a relatively fast feed rate, the depth of the engraving will not be the full depth that the cnc machine has plunged the tool. The engraving tool will not have sufficient time to plunge all the way down to the specified depth. The spring in the Spring Loaded Engraving Tool will compress and the engraving tool bit will skim across the surface at a depth less than the full depth specified by the cnc machine. If the plunging feed rate at the start of each line is not fast enough and the material is very soft, the engraving tool bit will have sufficient time to plunge deeper into the surface of the work piece than the amount that the tool plunges into the surface when it is traveling over the surface of the work piece. The engraving tool bit will essentially be drilling down into the work piece at the start of each line that is engraved. This will cause the appearance of each engraved line to have a circle or small hole at the starting point. It is desirable to prevent the engraving tool bit from being able to plunge too deeply into the workpiece at the start of each engraved line to ensure that all the lines will be consistent.

Manufacturers such as Gravograph (Duluth, Ga.) and Vision Computerized Engraving Systems Phoenix, Ariz.) have developed engraving spindles that incorporate a device for controlling the depth of engraving and use a spring for pressing the engraving tool against the workpiece to be engraved. These engraving spindles are integrated components of the cnc engraving machines and are not designed to be held in a collet or endmill type holder and placed into a rotating spindle of a cnc machine tool such as a milling type machine. These engraving machines have their own motor therein for rotating the spindles carrying the rotating engraving tool bits. An integral nosepiece can be placed onto the bottom of the engraving spindle to position a given length of the engraving tool that protrudes from the end of the engraving spindle, but the nosepiece must be attached to a non-rotating portion of the spindle coupled to the cnc machine. Furthermore, the nosepiece does not function as a means for holding a collet for gripping the engraving tool and does not rotate, and also the mechanism that allows the engraving tool to float is unable to rotate and must be held stationary with respect to the cnc machine.

These engraving spindles have a very long engraving tool inserted into them from the top side of the spindle opposite the bottom side adjacent the tool point, i.e. the engraving tool is inserted into the top of the spindle instead of the bottom. Thus the engraving tool must be longer than the length of the entire spindle so it can protrude out of the bottom of the spindle. A knob with a set screw on the top of the rotating inner spindle is the means for holding and vertically positioning the engraving tool over the workpiece. The long engraving tool must be supported along its length to prevent wobbling or whipping of the tool. This is accomplished by passing the engraving tool through a long precision diameter hole in the inner spindle that supports the engraving tool at both ends. The nosepiece does not provide any engraving tool holding mechanism.

A significant problem with this type of top loading engraving spindle is that when the engraving tool dulls and needs to be replaced, the entire process for setting the length of the tip protruding from the end must be performed again. There is no repeatable means for easily setting the tool length. Additionally, the long engraving tools are more costly to produce.

Kavo (Leutkirch, Germany) developed an engraving spindle that incorporates an integral motor with a mechanism that allows floating of the engraving tool. They incorporated a collet and collet nut that are attached directly to the rotating motor shaft. The housing that incorporates the floating mechanism is clamped to the cnc machine and the entire motor, motor shaft, collet, and engraving tool are able to float. The nosepiece is attached to the non rotating floating mechanism. This design could allow repeatable locating of the engraving tool when a dull engraving tool is replaced by a sharp one, but does not allow the entire floating system to be held in a rotating collet or endmill holder of a cnc milling type machine. Therefore the floating tool may not easily be removed from the cnc machine. This is a serious detriment to the manufacturing process. If multiple type tools are needed to produce a part, for example, if a part needs to be drilled with two drills with different diameters and then engraved, it would not be possible with either of the above designs.

The spring loaded engraving tool of the aforesaid Nelson U.S. Pat. No. 6,834,434 overcomes this major problem by being able to be held by a collet or endmill holder and placed into the rotating spindle of a standard milling type machine. It has a collet holder with a short hole on the end for receiving a collet and an engraving tool. The collet and engraving tool are inserted into the hole until they reach the bottom. A collet nut with an integral nosepiece is threaded onto the collet holder of the spring loaded engraving tool to compress the collet and firmly hold the engraving tool. Different diameter collets and engraving tools can be inserted into the collet holder. Since the engraving tools are all made to the same length, it is not necessary to reset the nosepiece to adjust the length of the engraving tool tip protruding from the end as discussed hereinabove.

SUMMARY OF PREFERRED EMBODIMENTS OF THE INVENTION

In order to alleviate the above mentioned problems associated with the prior art, the collet nut on the aforesaid spring-loaded toolholder that applies a relatively constant pressure upon a rotating engraving toolbit as it is pushed against the material, is modified by mounting a depth controlling nosepiece upon the collet nut. The resulting modified spring-loaded engraving toolholder is held in a standard collet or endmill toolholder and placed into the spindle of a standard cnc milling type machine.

More specifically, a collet holder for receiving a tool bit is rotatable along with the main cylindrical body of the spring loaded tool holder, the collet holder being movable longitudinally along the length of the cylindrical body and being spring biased in a forward direction toward the workpiece. A tool bit depth limiting nosepiece, having internal threading is screwed onto a threaded male end of the collet nut, and the nosepiece is rotated relative to the threaded male end of the collet nut and functions to adjust and limit the desired protrusion distance that the tool bit extends from the flat end surface of the nose piece. The desired protrusion distance is fixed by a setscrew in the nosepiece that prevents further rotation of the nosepiece and thus sets the desired protrusion distance.

In an alternative embodiment of the invention, one or more spacer members consisting of annular washers having precise thicknesses, are sandwiched between the collet nut and the nosepiece for fixing the desired distance that the toolbit protrudes from the front face of the nosepiece.

DESCRIPTION OF THE DRAWINGS

The invention will be more fully understood from the following detailed description taken in conjunction with the accompanying drawings in which.

DETAILED DESCRIPTION OF PREFERRED EMBODIMENTS OF THE INVENTION

Figure 1:
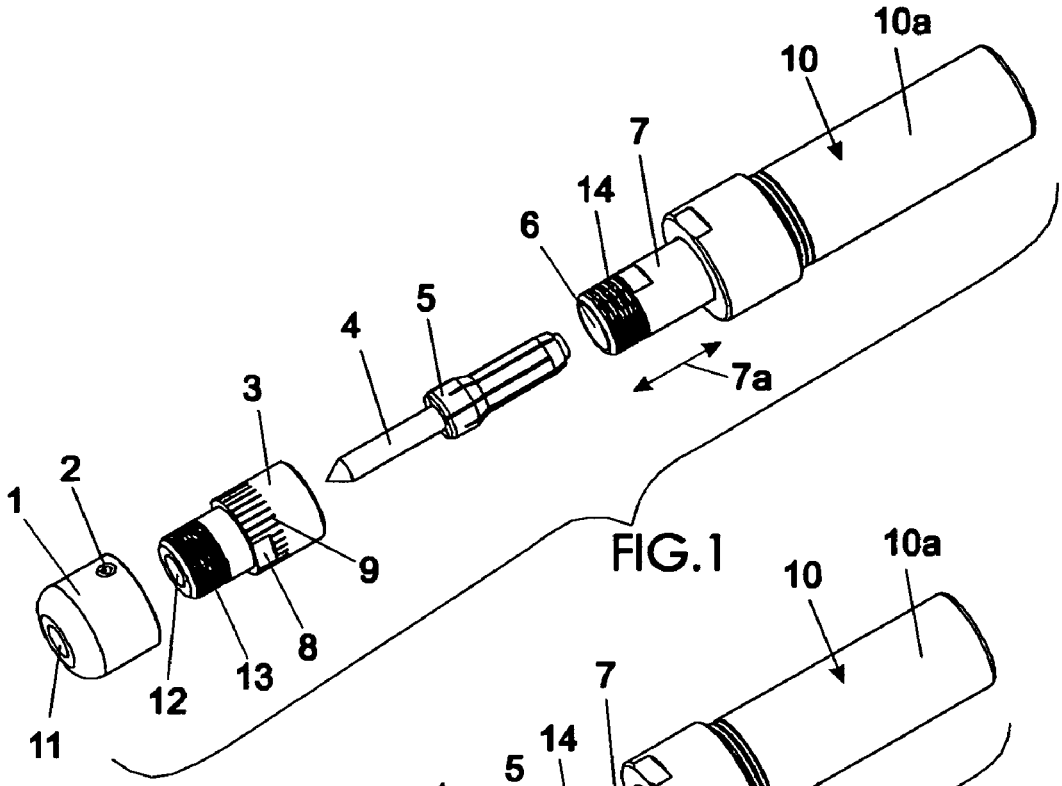
FIG. 1 is an exploded perspective view of a first embodiment of a depth controlling nosepiece and a spring-loaded engraving toolholder.
Figure 2:
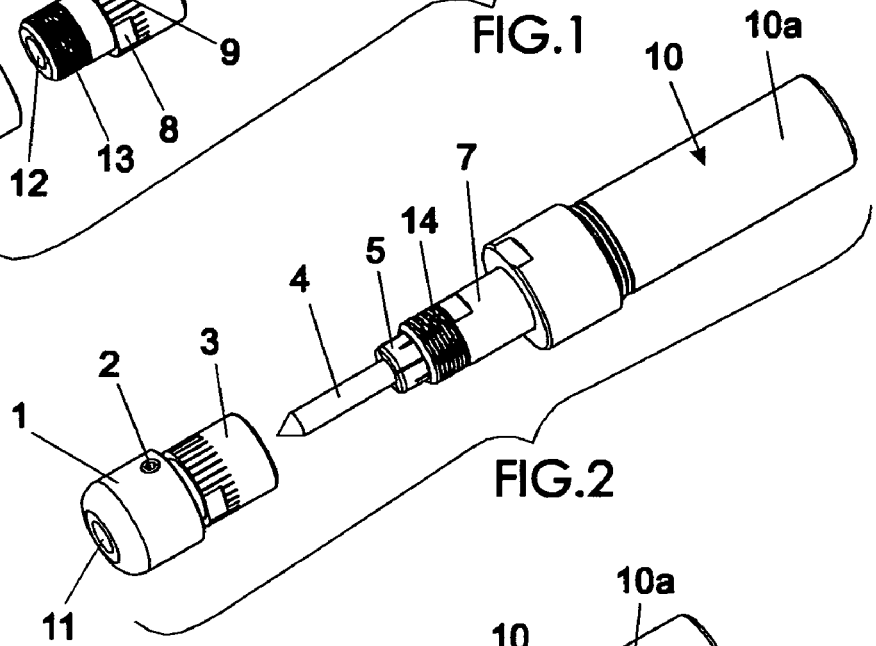
FIG. 2 is a partially assembled exploded perspective view of a first embodiment of a depth controlling nosepiece and a spring-loaded engraving toolholder.

Referring to FIGS. 1 and 2, the present invention can employ a collet nut 3 and a nosepiece 1. The spring loaded engraving tool 10 has a moveable collet holder 7 that has a hole 6 for receiving a collet 5 and engraving toolbit 4. The moveable collet holder 7 is able to move longitudinally within the main body 10*a* of the spring loaded engraving tool 10 and is mechanically biased in a forward direction toward the nosepiece 1. The double headed arrow 7*a* shows the direction the collet holder 7 is able to move relative to the main body 10*a*.

The collet holder 7 has threads 14 for receiving a collet nut 3 to hold and compress the collet 5 which in turn holds the engraving tool 4 in place. The collet nut 3 also has external threads 13 for attachment of a nosepiece 1. The collet nut has a thru hole 12 and the nosepiece has a thru hole 11 to allow the engraving tool 4 to pass through them.

Figure 3:
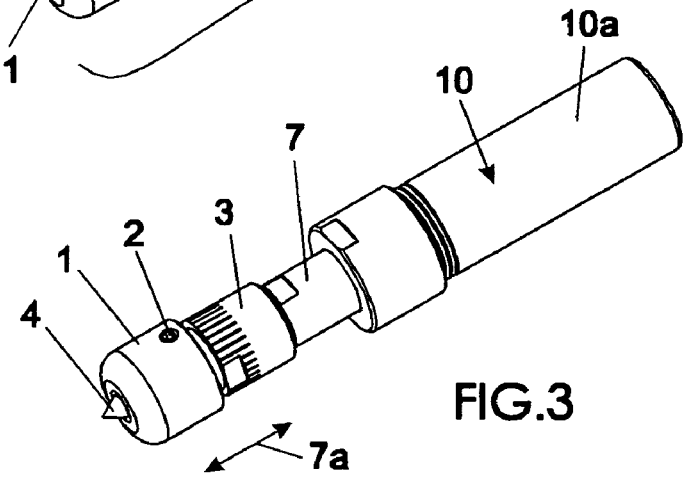
FIG. 3 is an assembled perspective view of a first embodiment of a depth controlling nosepiece and a spring-loaded engraving toolholder.

The engraving tool 4 is inserted into the collet 5 and both are inserted into the hole 6 in the collet holder 7. The internally threaded nosepiece 1 is threaded onto the collet nut 3 at the threaded male portion 13 of the collet nut. The coupled collet nut and nosepiece are in turn threaded onto the collet holder 7 with threads 14. The collet nut 3 can be tightened onto the collet holder 7 with a wrench that fits onto the wrench flats 8. Upon assembly, the engraving tool 4 will protrude through the end of the nosepiece as can be seen in FIG. 3.

To adjust the amount that the engraving tool 4 protrudes from the nosepiece 1, the nosepiece is rotated either clockwise or counterclockwise to thread the nosepiece onto or off of the collet nut 3. A set screw 2 holds the nosepiece in position once the nosepiece has been moved to the desired location.

Markings 9 are placed around the circumference of the collet nut 3. These equally spaced markings correspond to a fixed incremental movement of the nosepiece relative to the collet nut in the axial direction. This relative movement controls the desired protrusion distance that the engraving tool 4 protrudes from the end of the nosepiece to be set by the setscrew 2 in a repeatable manner. For example, rotating the nosepiece the equivalent of one indicia mark 9 with respect to a baseline marking on the nosepiece, such as an edge of setscrew 2, would cause the engraving tool to extend 0.001" further from the nosepiece. The position indicating indicia markings 9 could be designed to identify any desired amount of axial movement depending on the thread configuration used in the collet nut and nosepiece. Markings 9 could be impressed upon the nose piece instead of upon the collet nut.

Figure 4:
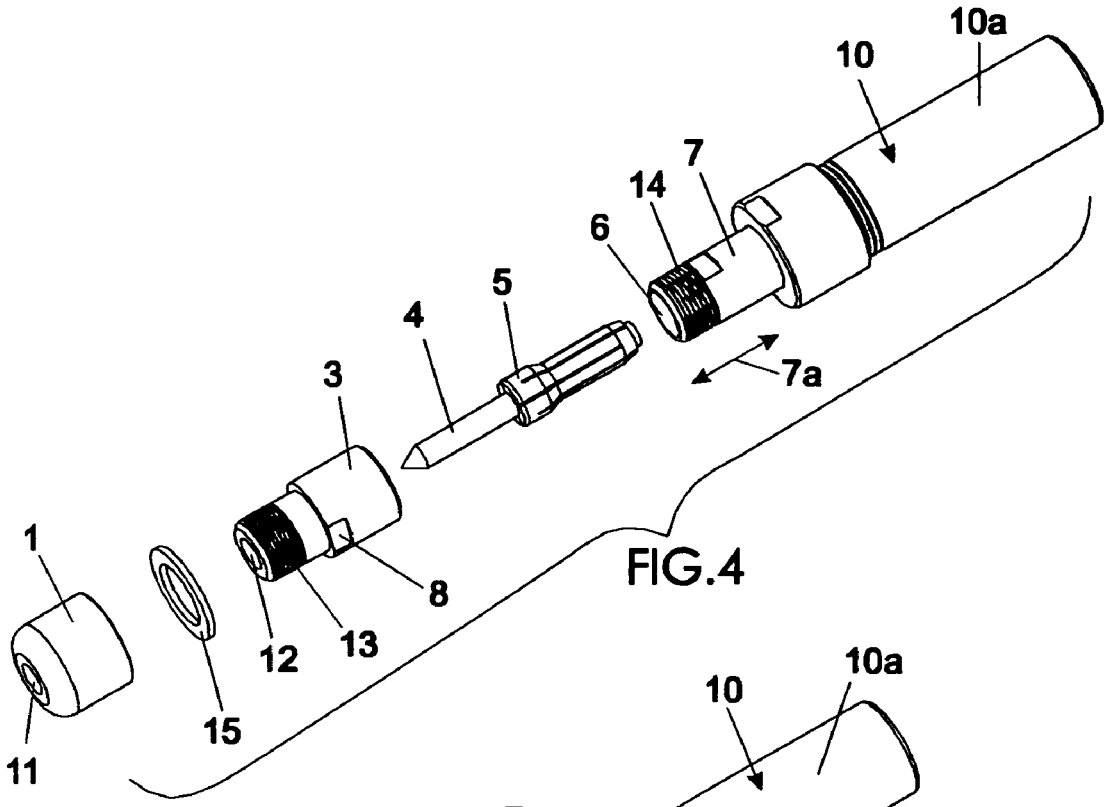
FIG. 4 is an exploded perspective view of a second embodiment of a depth controlling nosepiece and a spring-loaded engraving toolholder.
Figure 5:
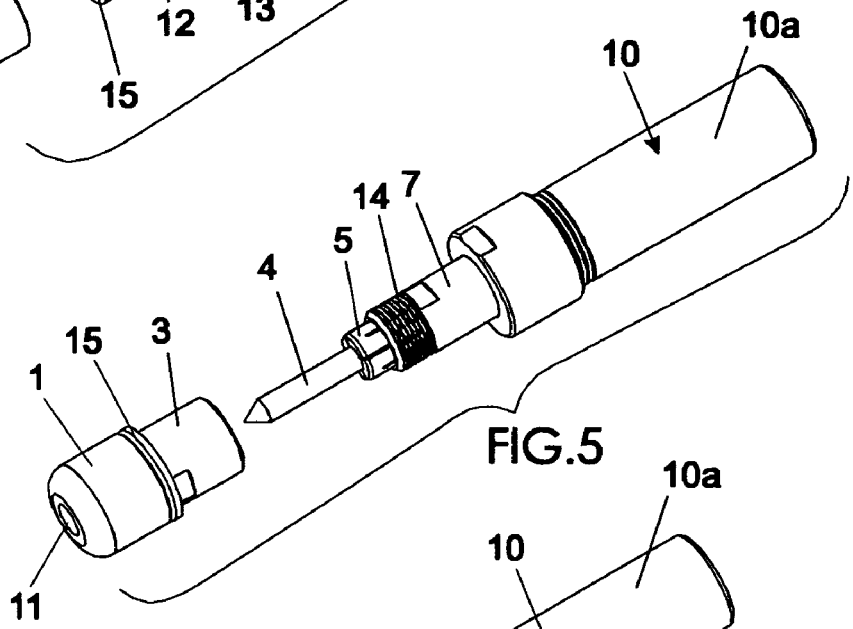
FIG. 5 is a partially assembled exploded perspective view of a second embodiment of a depth controlling nosepiece and a spring-loaded engraving toolholder.
Figure 6:
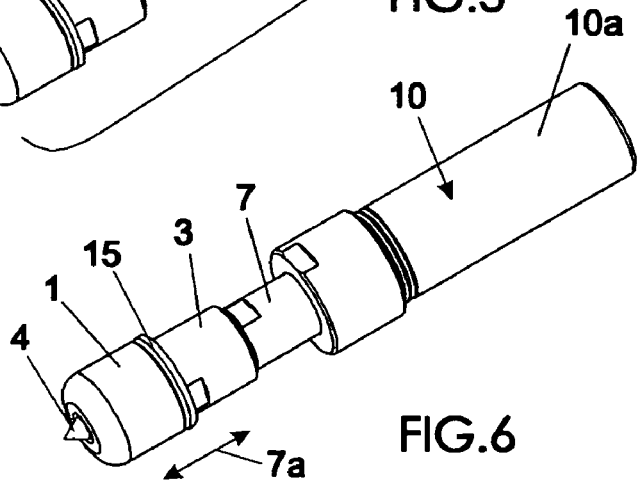
FIG. 6 is an assembled perspective view of a second embodiment of a depth controlling nosepiece and a spring-loaded engraving toolholder.

FIGS. 4 to 6 identify a second embodiment of the engraving tool positioning means for limiting or adjusting the distance or depth that the tool bit is able to protrude from the end of the nosepiece. In this embodiment, an annular ring spacer member 15, which can be a washer of precise thickness, is placed onto the collet nut 3 before threading the nosepiece 1 onto the collet nut, to establish the desired protrusion distance of the tool from the end of the nosepiece. Also, the engraving tool 4 can protrude from the end of the nosepiece in different predetermined amounts by varying the thickness of the spacer or adding multiple spacers.

Therefore, when the spring loaded engraving tool is placed into the rotating spindle of a cnc milling type machine or equivalent and plunged into the workpiece to be engraved, the engraving tool is unable to plunge any deeper than the predetermined amount protruding from the nosepiece, as may be established by the aforesaid adjustment means.

While the invention has been described in connection with preferred embodiments, the description is not intended to limit the scope of the invention to the particular forms set forth, but on the contrary, it is intended to cover such alternatives, modifications, and equivalents as may be included within the spirit and scope of the invention as defined by the appended claims. For example, the term "spring loaded engraving tool" is intended to cover any tool that is mechanically biased or made to float or maintain pressure against a workpiece being engraved, whether or not employing a conventional spring. The term "machine tool" could be any tool capable of driving the engraving tool. For example, the machine tool could be a manually controlled engraving machine instead of the preferred computer controlled machine tool. Other less preferred embodiments could employ space members coupled somewhere between the nosepiece and the collet holder and would have a similar effect as placing the spacers between the nosepiece and the collet nut. For example spacers could be placed between the engraving tool bit and the bottom of the hole in the collet holder, or between the collet nut and the collet.

What is claimed is:

1. A spring loaded engraving tool comprising:

(a) a main body of said spring loaded engraving tool configured to be held by a tool holder of a machine tool for driving said engraving tool;

(b) a collet holder, coupled to said main body, for receiving a collet for gripping an engraving tool bit, said collet holder being movable along the length of said main body of said spring loaded engraving tool and biased in a forward direction extending away from the main body of said spring loaded engraving tool;

(c) a collet nut, coupled to said collet holder, for causing said collet to grip said engraving tool bit;

(d) a tool bit depth limiting nosepiece, coupled to said collet nut, having a nosepiece passageway for permitting said tool bit to pass through said passageway and protrude from said nosepiece by a given protrusion distance; and (e) adjustment means for adjusting the given protrusion distance that the tool bit is able to protrude from said nosepiece.

2. The engraving tool of claim 1 wherein said adjustment means comprises a threaded male portion of said collet nut that screws into a female threaded portion of said nosepiece, enabling said given protrusion distance to be varied by producing relative motion between the nosepiece and said collet nut.

3. The engraving tool of claim 2 including means for fixing the rotational position of said nosepiece relative to said collet nut after production of said relative motion.

4. The engraving tool of claim 3 wherein said means for fixing comprises a setscrew located within said nosepiece.

5. The engraving tool of claim 2 wherein position indicating indicia are associated with said collet nut for indicating increments of movement of said nosepiece relative to said collet nut for aiding in attaining precise control of said given protrusion distance.

6. The engraving tool of claim 3 wherein position indicating indicia are associated with said collet nut for indicating increments of movement of said nosepiece relative to said collet nut for aiding in attaining precise control of said given protrusion distance.

7. The engraving tool of claim 4 wherein position indicating indicia are associated with said collet nut for indicating increments of movement of said nosepiece relative to said collet nut for aiding in attaining precise control of said given protrusion distance.

8. The engraving tool of claim 1 wherein said adjust means for adjusting the given protrusion distance that the tool bit is able to protrude from said nosepiece comprises spacer means positioned between said collet nut and said nosepiece.

9. The engraving tool of claim 8 wherein said spacer means comprises one or more annular ring members of predetermined thickness sandwiched between said collet nut and said nosepiece.

10. The engraving tool of claim 9 wherein said annular ring members consist of one or more washers.

11. A spring loaded engraving tool comprising:

(a) a main body of said spring loaded engraving tool configured to be held by a tool holder of a machine tool for driving said spring loaded engraving tool;

(b) a collet holder, coupled to said main body, for receiving a collet for gripping an engraving tool bit, said collet holder being movable along the length of said main body of said spring loaded engraving tool and biased in a forward direction extending away from the main body of said spring loaded engraving tool;

(c) a collet nut, coupled to said collet holder, for causing said collet to grip said engraving tool bit;

(d) a tool bit depth limiting nosepiece coupled to said collet nut having a nosepiece passageway for permitting said tool bit to pass through said passageway and protrude from said nosepiece by a given protrusion distance; and (e) positioning means for fixing the given protrusion distance that the tool bit is able to protrude from said nosepiece.

12. The engraving tool of claim 11 wherein said positioning means comprises one or more spacer members having predetermined thickness coupled between said collet nut and said nosepiece.

13. The engraving tool of claim 12 wherein said spacer members comprise one or more annular ring members sandwiched between said collet nut and said nosepiece.

14. The engraving tool of claim 13 wherein said annular ring members consist of washers.

15. The engraving tool of claim 11 wherein said positioning means comprises one or more spacer members having predetermined thickness coupled between said nosepiece and said collet holder.

16. Engraving apparatus comprising:

(a) a spring loaded engraving tool having a main body inserted within a spindle of a machine tool for driving said spring loaded engraving tool;

(b) a collet holder, coupled to said main body, for receiving a collet for gripping an engraving tool bit, said collet holder being movable along the length of said main body of said spring loaded engraving tool and biased in a forward direction extending away from the main body of said spring loaded engraving tool;

(c) a collet nut, coupled to said collet holder, for causing said collet to grip said engraving tool bit;

(d) a tool bit depth limiting nosepiece coupled to said collet nut having a nosepiece passageway for permitting said tool bit to protrude from said nosepiece by a given protrusion distance; and (e) positioning means for liming the given protrusion distance that the tool bit is able to protrude from said nosepiece.

17. The engraving apparatus of claim 16 wherein said positioning means comprises a threaded male portion of said collet nut that screws into a female threaded portion of said nosepiece, enabling said given protrusion distance to be varied by producing relative motion between the nosepiece and said collet nut.

18. The engraving apparatus of claim 17 including means for fixing the rotational position of said nosepiece relative to said collet nut after production of said relative motion.

19. The engraving apparatus of claim 18 wherein position indicating indicia are associated with said collet nut for indicating increments of movement of said nosepiece with respect to said collet nut for aiding in attaining precise control of said given protrusion distance.

20. The engraving apparatus of claim 16 wherein said positioning means comprises one or more spacer members having precise thickness coupled between said collet nut and said nosepiece.

21. The engraving apparatus of claim 20 wherein said spacer members comprise one or more annular ring members sandwiched between said collet nut and said nosepiece.

* * * * *